US006692248B2

(12) United States Patent
Huang et al.

(10) Patent No.: US 6,692,248 B2
(45) Date of Patent: Feb. 17, 2004

(54) LIGHTER WITH HIGH-VOLTAGE DISCHARGE CONTROL

(75) Inventors: Xinhua Huang, 6-201 Yubo Garden Hushan Zhen, Cixi city, Zhejiang (CN); Zhihong Jiang, Cixi (CN)

(73) Assignee: Xinhua Huang, Cixi (CN)

( * ) Notice: Subject to any disclaimer, the term of this patent is extended or adjusted under 35 U.S.C. 154(b) by 0 days.

(21) Appl. No.: 10/253,774

(22) Filed: Sep. 24, 2002

(65) Prior Publication Data

US 2003/0232296 A1 Dec. 18, 2003

(30) Foreign Application Priority Data

Jun. 12, 2002 (CN) ..... 2218183 A

(51) Int. Cl.[7] ..... F23D 11/36
(52) U.S. Cl. ..... 431/153; 431/255; 431/256
(58) Field of Search ..... 431/153, 255, 431/256, 257, 264, 266

(56) References Cited

U.S. PATENT DOCUMENTS 3,832,127 A * 8/1974 Moriya ..... 431/344
4,149,843 A * 4/1979 Heller et al. ..... 431/266
5,839,892 A * 11/1998 Hwang ..... 431/153
6,086,358 A * 7/2000 Potskhishvili et al. ..... 431/153
6,422,860 B2 7/2002 Sung
2002/0061486 A1 5/2002 Huang

* cited by examiner

*Primary Examiner*—Alfred Basichas
(74) *Attorney, Agent, or Firm*—Senniger, Powers, Leavitt & Roedel

(57) ABSTRACT

The present invention relates to a gas lighter with high-voltage discharge control. In the existing lighter, when an actuator button is pressed, the discharge takes place between the high-voltage electrode and the gas nozzle, thereby the combustible gas is ignited, but such a lighter has unsatisfying safety. The lighter according to the present invention comprises a fuel tank, piezo-electric device and gas outlet device inside the fuel tank, and a windscreen above the gas outlet device. The piezo-electric device comprises a piezo-electric block, an actuator button associated with said piezo-electric block and a conducting wire. One end of the conducting wire is fixed to the piezo-electric block, the other end is fixed to the upper part of the fuel tank as a high-voltage electrode, characterized in that in the windscreen there are a conductor element, which can be brought close to the high-voltage electrode, and a control element connected thereto, said control element is connected to the gas outlet device. The lighter according to the present invention has a simple structure and can be easily operated. The discharge between the nozzle and the electrode can not take place even when the actuator button is pressed in a non-operation condition, and thus the gas will not be ignited, therefore, the safety of the lighter is greatly improved.

8 Claims, 2 Drawing Sheets

LIGHTER WITH HIGH-VOLTAGE DISCHARGE CONTROL

FIELD OF THE INVENTION

The present invention relates to a lighter with high-voltage discharge control.

DESCRIPTION OF THE PRIOR ART

In the existing gas lighter of discharge-spark type, the combustible gas from a nozzle is ignited by the spark generated from the discharge between a high-voltage electrode and the nozzle that functions as a grounded electrode. The lighter will be ignited and as a result flame will be generated when an actuator button is pressed and a high-voltage discharge occurs between the nozzle and the high-voltage electrode. Any unintentional or error operation, an operation by a child or accidental collision by a hard article will easily ignite the lighter and thus generate flame, thereby hurting the child or even endangering the public safety. Such a lighter is not perfect in safety.

SUMMARY OF THE INVENTION

The problem to be solved and the technical object proposed by the present invention is to overcome the above mentioned technical defects of the prior art, and to provide a lighter with high-voltage discharge control between the gas nozzle and the high-voltage electrode, such that the combustible gas can not be ignited when the actuator button is pressed in non-operation condition, thereby obtaining a lighter with higher safety.

The above object can be fulfilled by a lighter with high-voltage discharge control according to the present invention, which comprises: a fuel tank, a piezo-electric device and a gas outlet device disposed inside the fuel tank, and a windscreen surmounting the outlet device, wherein the piezo-electric device is comprised of a piezo-electric block, an actuator button associated with said piezo-electric block and a conducting wire, one end of which, as high-voltage electrode, is connected to the piezo-electric block and the other end of which is disposed at the upper portion of the fuel tank, and said gas outlet device comprises an outlet valve and a nozzle, characterized in that inside the windscreen are provided with a conductor element which can be positioned close to the high-voltage electrode, and a control element connected to the conductor element, the control element is also connected to the gas outlet device. In a non-operation condition where the conductor element is positioned adjacent to the high-voltage electrode, when the actuator button is pressed the discharge occurs between the conductor element and the high-voltage electrode rather than between the nozzle and the high-voltage electrode, thus no spark will be generated at the nozzle and the lighter will not be ignited, whereby the safety of the lighter is greatly increased. In an operation condition where the conductor element is turned away from the high-voltage electrode to enable the discharge between the nozzle and the high-voltage electrode to generate whereby igniting the lighter. The control element is provided to rotate the conductor element for making the same away from or close to the high-voltage electrode such that the discharge between the gas nozzle and the high-voltage electrode can take place or not.

In the lighter with high-voltage control according to the present invention, a return spring for resetting the control element is placed on and around the core of the gas outlet or release valve, so as to ensure the safety of the lighter in the non-operation condition, one end of the return spring is connected to the fuel tank and the other end of the return spring is disposed on a positioning rod of the control element or directly fixed to the control element.

According to one aspect of the lighter with the high-voltage discharge control in accordance with the present invention, the conductor has a free end which is arranged between the high-voltage electrode and the gas nozzle and can be positioned close to the high-voltage electrode; the other end of the conductor is connected to the control element or is integral with the return spring. The conductor element is made of metal wire, which has an upper portion in the form of an arc and a lower portion in a line shape. The conductor element can also be made of metal sheet with an arc form.

According to another aspect of the lighter with high-voltage discharge control, the control element is provided with a protrusion that is located in a cutout of the windscreen.

The lighter according to the present invention has a simple structure and can be easily operated. The discharge between the nozzle and the high-voltage electrode can be controlled by the conductor element, such that in the non-operation condition, even when the actuator button is pressed no discharge will occur between the high-voltage electrode and the gas nozzle and thus the gas will not be ignited, therefore, the safety of the lighter is greatly improved.

The present invention will be described in detail by way of example and with reference to the accompanying drawings.

DESCRIPTION OF THE PREFERRED EMBODIMENT

Figure 1:
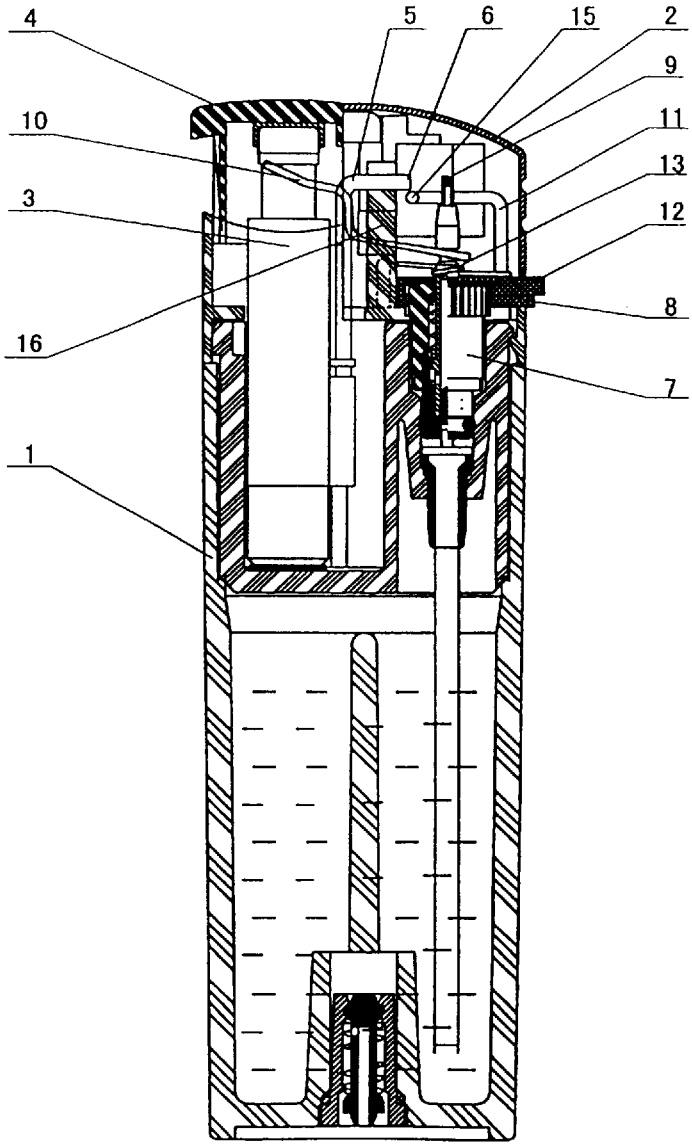
FIG. 1 is a schematic view of the structure of the lighter according to present invention in a non-operation condition.
Figure 2:
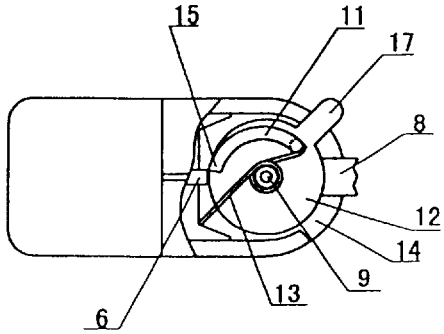
FIG. 2 is a top plan view of lighter shown in FIG. 1 with partial cutout.

As shown in FIGS. 1 and 2, the lighter with high-voltage discharge control comprises a fuel tank 1, a piezo-electric device and a gas outlet device located inside the fuel tank, a windscreen 2 arranged above the gas outlet device and an inner shield 16 fixed in the fuel tank. Inside the windscreen there are provided with a conductor element 11 near a high-voltage electrode 6 and a control element 12 connected to the conductor element 11. The piezo-electric device comprises a piezo-electric block 3, an actuator button 4 associated with the piezo-electric block and a conducting wire 5. One end of the conducting wire is fixed to the piezo-electric block 3, the other end of which, as the high-voltage electrode 6, is fixed to the inner shield 16 located at the upper portion of the fuel tank. The gas outlet device comprises an outlet valve 7, a lever 10, a flame-adjusting ring 8 and a nozzle 9 as a grounded electrode. The control element 12 surmounts the upper end of the outlet valve 7 and is provided with a protrusion 17. The windscreen 2 is formed with a cutout or slot 14 for the rotation of the protrusion 17. A return spring 13 is mounted around the top portion of the gas outlet valve 7, one end of the return spring 13 is connected to the fuel tank body and the other end of which is connected to the control element 12. The conductor element 11 is made of metal wire, the upper portion of which has a form of an arc with the same or similar radian as the inner wall of the windscreen facilitating its rotation inside the windscreen 2, and the lower portion of the conductor element is in the shape of a line. One end of this conductor element is a free end 15 that is arranged between the high-voltage electrode 6 and the nozzle 9 and closes to the high-voltage electrode 6, the other end of which is integral with the return spring 13.

In the non-operation condition, as shown in FIGS. 1 and 2, when the actuator button 4 is pressed, the discharge takes place between the free end of the conductor element 11 close to the high-voltage electrode 6 and the high-voltage electrode rather than between the nozzle 9 and the high-voltage electrode 6, thus no spark is generated on the top of the nozzle 9, thereby the combustible gas can not be ignited.

Figure 3:
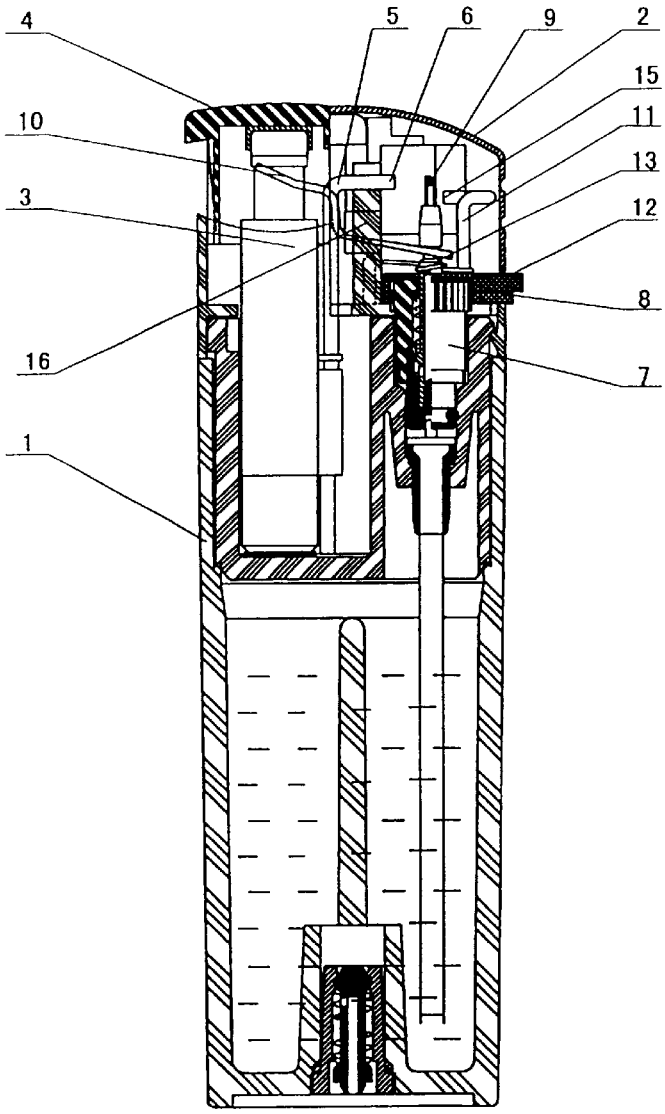
FIG. 3 is a schematic view of the structure of the lighter according to the present invention in an operation condition.
Figure 4:
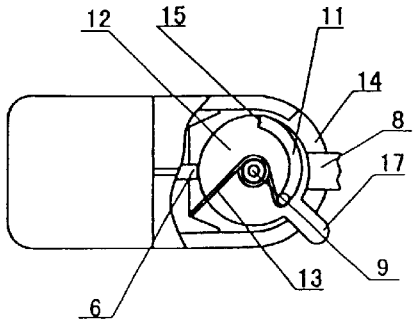
FIG. 4 is a top plan view of the lighter shown in FIG. 3 with partial cutout.

In the operation condition, as shown in FIGS. 3 and 4, the protrusion 17 on the control element 12 is turn aside and the conductor element 11 is thus rotated such that its free end is positioned far away from the high-voltage electrode 6. At this time the discharge would occur not between the high-voltage electrode 6 and the free end of the conductor element 11, but between the high-voltage electrode 6 and the nozzle 9, therefore, spark is generated on the top end of the nozzle 9 and thus the combustible gas is ignited. After the operation, the control element 12 is reset automatically to its original position by the action of the return spring 13.

With reference to FIGS. 1 through 4, it is noted that invention disclosed herein is not to be limited by the embodiments shown in the figures and described in the description, which is provided by way of example and not of limitation, but only in accordance with the scope of appended claims.

We claim:

1. A lighter with high-voltage discharge control comprising a fuel tank (1), a piezo-electric device and a gas outlet device located inside the fuel tank (1) and a windscreen (2) positioned above the outlet device, wherein said piezo-electric device comprises a piezo-electric block (3), an actuator button (4) associated with said piezo-electric block (3) and a conducting wire (5), one end of the conducting wire is fixed to the piezo-electric block (3), and the other end of the conducting wire is fixed to the upper part of the fuel tank as a high-voltage electrode (6), said gas outlet device comprises an outlet valve (7) and a nozzle (9), wherein a conductor element (11) and a control element (12) connected thereto are provided in said windscreen (2), said control element (12) is connected to said gas outlet device.

2. A lighter with high-voltage control according to claim 1, wherein a return spring (13) is mounted on and around said gas outlet device, one end of the return spring is connected to the fuel tank, and the other end of which is disposed on a positioning rod of said control element (12) or is directly fixed to said control element (12).

3. A lighter with high-voltage discharge control according to claim 2, wherein one end of said conductor (11) is a free end (15), which, in a non-operation condition, is located between the high-voltage electrode (6) and the nozzle (9) and closes to the high-voltage electrode (6), the other end of said conductor element is connected to the control element (12) or is integral with said return spring (13).

4. A lighter with high-voltage discharge control according to claim 3, wherein said conductor (11) is made of metal wire, the upper portion of which is in an arc form and the lower portion is in the shape of a line.

5. A lighter with high-voltage discharge control according to claim 3, characterized in that said conductor (11) is a metal sheet with the form of an arc.

6. A lighter with high-voltage discharge control according to claim 1, characterized in that said control element (12) is provided with a protrusion (17), which is positioned in a cutout (14) formed in the windscreen (2).

7. A lighter with high-voltage discharge control according to claim 4, wherein said control element (12) is provided with a protrusion (17), which is positioned in a cutout (14) formed in the windscreen (2).

8. A lighter with high-voltage discharge control according to claim 5, wherein said control element (12) is provided with a protrusion (17), which is positioned in a cutout (14) formed in the windscreen (2).

* * * * *